United States Patent [19]

Salisbury

[11] Patent Number: 5,000,985

[45] Date of Patent: Mar. 19, 1991

[54] METHOD OF POWDER COATING

[75] Inventor: Richard Salisbury, Laguna Niguel, Calif.

[73] Assignee: Western Finishing Systems, Inc., San Clemente, Calif.

[21] Appl. No.: 486,513

[22] Filed: Feb. 28, 1990

[51] Int. Cl.[5] ..... B05D 5/00

[52] U.S. Cl. ..... 427/198; 427/203; 427/270; 427/287; 427/355; 427/388.1; 427/409; 427/424

[58] Field of Search ..... 427/198, 203, 270, 287, 427/355, 388.1, 409, 424

*Primary Examiner*—Bernard Pianalto

*Attorney, Agent, or Firm*—Blodgett & Blodgett

[57] ABSTRACT

An apparatus for and method of coating an article by the use of electro-static attraction of ionized particles which are subsequently cured. The apparatus includes a first foraminous conveyor for carrying the article through a powder coating zone and a second conveyor for carrying the article through a curing zone. The surface of the article which rests on the foraminous conveyor is cleaned of particles as the article is transferred from the first foraminous conveyor to the second conveyor. The first foraminous conveyor is also cleaned of particles after the article has been transferred. After the articles have been cured to form a coating on the article, the article is put through the coating system again except that the article is supported on the conveyor so that the surface which was not coated in the first pass through the system is out of contact with the conveyor. During the subsequent pass of the article through the coating zone, the uncoated surface of the article is then covered with powder which is subsequently cured during the second pass of the article through the curing zone. The second coating step for the article may be accomplished by passing the article through the same apparatus as for the first step or by passing the article through a second identical apparatus.

10 Claims, 5 Drawing Sheets

FIG. 6
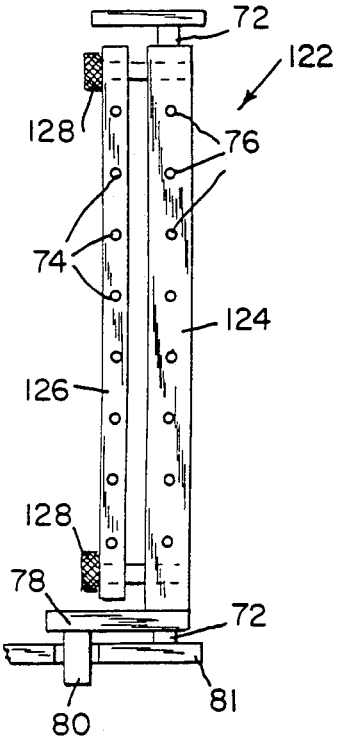
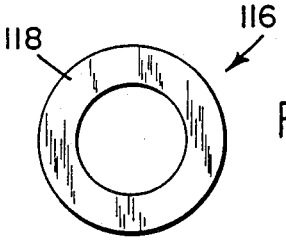
FIG. 7
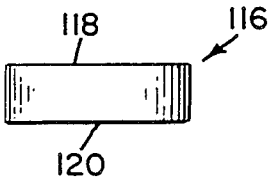
FIG. 8
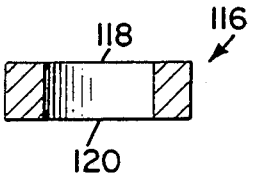
FIG. 9
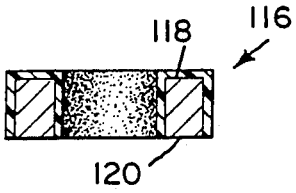
FIG. 10
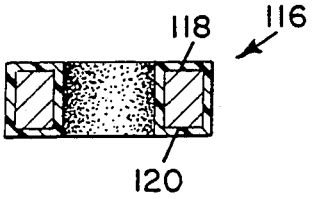
FIG. 11

METHOD OF POWDER COATING

BACKGROUND OF THE INVENTION

The present invention relates generally to a method of an apparatus for coating articles and, specifically, for coating metallic articles with plastic resin by a process which is known in the industry as powder coating. The articles to be coated are conveyed on a foraminous metallic conveyor through a spray booth. As the articles pass through the spray booth, they are coated with ionized particles of an uncured plastic resin. The resin particles are projected in the form of a spray for an electrode unit which charges and ionizes the particles. The articles to be coated are grounded through the metallic conveyor. The particles are attracted to the grounded article and deposited to all exposed surfaces of the article. The articles are then conveyed to a curing oven which cures or fixes the particles to the articles to form a permanent coating on the articles.

Since the metallic conveyor is also grounded, particles are attracted to the conveyor so that the particles also become fixed to the conveyor when the articles are conveyed to the curing oven. Eventually, the conveyor becomes completely coated with plastic. This coating clogs the openings in the conveyor and insulates the conveyor from the articles so that the articles are not grounded and, therefore, do not attract the ionized resin particles. As the ground connection between the articles and the conveyor diminishes, the equality of the coating also diminishes to an unacceptable level.

In order to maintain an exceptable quality of coating on the articles, the conveyor must be replaced by a clean conveyor. This results in downtime and costly lost production. The coated conveyor must be cleaned by burning the coating. However, this creates two additional problems. The burning of the plastic coating requires consumption of energy and creates toxic fumes which must be contained. The equipment for performing both of these tasks and the energy which is required to perform both tasks add considerably to the cost of the coating operation.

Another problem with the existing coating systems is that all the particles which are deposited on the conveyor represent waste.

A still further problem with existing coating systems is that the surface of the article which is in contact with the conveyor is not completely covered with particles when it passes through the spray booth. Also, after the resin coating has been cured, the articles stick to the conveyor and have to be forcefully removed from the conveyor. This can damage the coating on the article and the surface which was in contact with the article has a rough and incomplete coating. The article can be run through this system again so that a different surface of the article rests on the conveyor so that the surface which was incompletely coated can be covered completely. However, the rough and complete coating on that surface prevents the surface from obtaining a uniform finish coating. These and other difficulties experienced with the prior art coating systems have been obviated by the present invention.

It is, therefore, a principle object of the invention to provide a system for coating articles by electro-static attraction of resin particles in which the particles are removed from the surface of the article which rests on the conveyor prior to curing of the resin so that a subsequent passing of the article through the coating system enables the uniform coating to be applied to the surface which was not coated in the first pass of the article through the system.

A further object of the present invention is the provision of a second conveyor which transports the articles through the curing oven after the articles have been coated with resin particles or powder and means for automatically transferring the powder coated articles from the first foraminous conveyor to the second conveyor.

Another object of the present invention is to provide means for removing the uncured resin powder from the foraminous conveyor after the conveyor passes through the spray booth.

A still further object of the invention is the provision of means for collecting the uncured resin powder which is removed from the foraminous conveyor and the articles for subsequently use.

With these and other objects in view, as will be apparent to those skilled in the art, the invention resides in the combination of parts set forth in the specification and covered by the claims appended hereto.

SUMMARY OF THE INVENTION

In general, the invention consists of a system for applying a coating of uncured loose particulate material or powder to an article for subsequent fixing of the particulate material to the article to form a permanent coating about the exposed surfaces of the article. The apparatus comprises a first foraminous conveyor for conveying the articles through a spray zone or a spray booth, a second conveyor for conveying the articles which have been powder coated through a curing zone, and means for transferring the articles from the first conveyor to the second conveyor. More specifically, the surface of the article which rests on the foraminous conveyor is cleaned of uncured powder prior to being transferred to the second conveyor and the first foraminous conveyor is cleaned of uncured powder after the article has been transferred to the second conveyor. The powder which is removed from the article and the first conveyor is recycled.

BRIEF DESCRIPTION OF THE DRAWINGS

The character of the invention, however, may be best understood by reference to one of its structural forms, as illustrated by the accompanying drawings, in which:

FIG. 6 is a fragmentary plan view showing a modification of the article transferring mechanism, FIG. 7 is a plan view of one type of article which is suited for being coated by the apparatus of the present invention, FIG. 8 is a side elevational view of the article, FIG. 9 is a vertical cross-sectional view of the article taken along the line IX—IX of FIG. 7, FIG. 10 is a cross-sectional view of the article after it has been partially coated by a first pass of the article through the coating apparatus, and FIG. 11 is a vertical cross-sectional view of the article after it has been completely coated after a second pass of the article through the coating apparatus.

DETAILED DESCRIPTION OF THE INVENTION

Figure 1A:
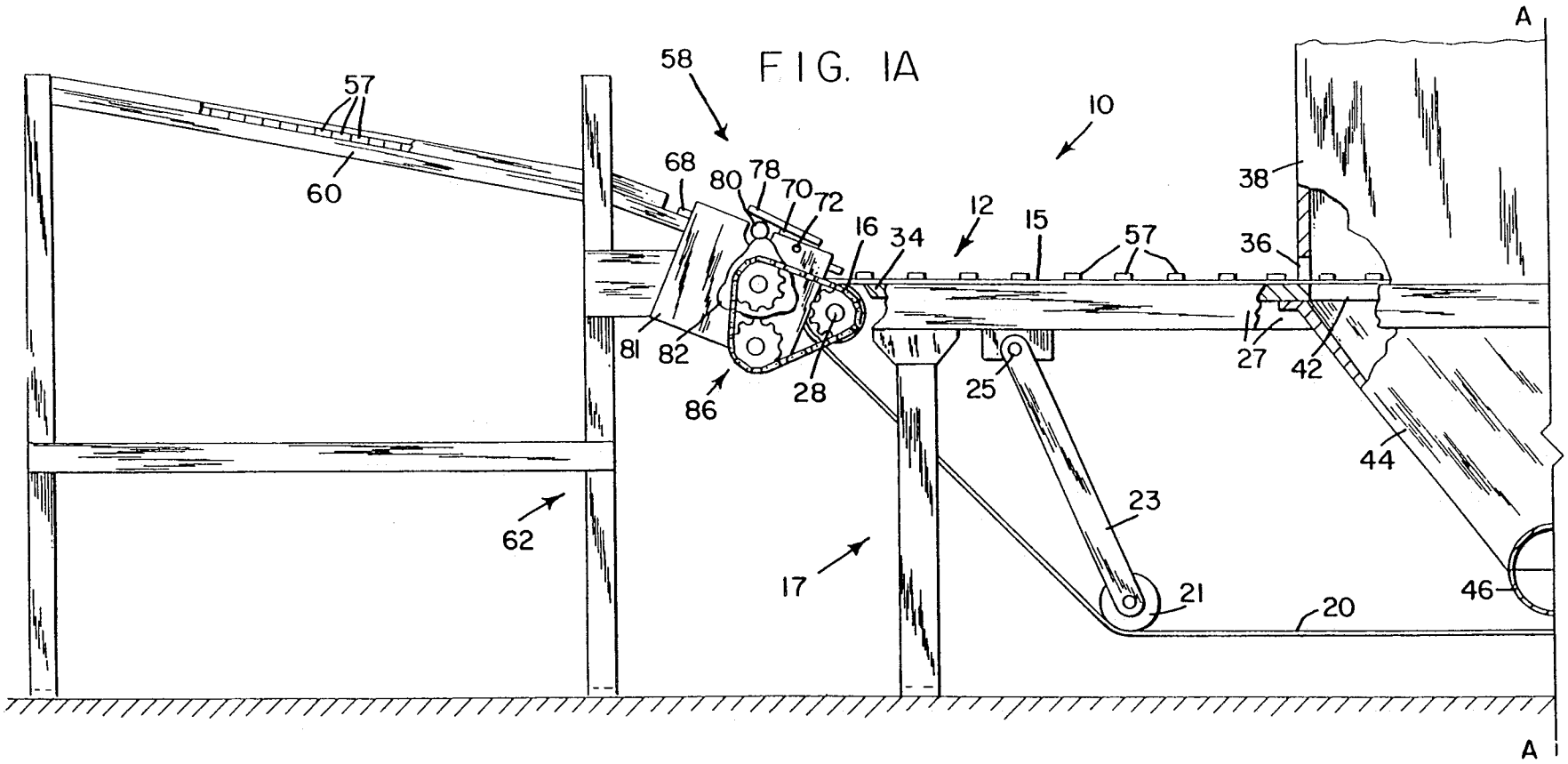
FIGS. 1*a* and 1*b* are side elevational views which may be joined together along the common line A—A and which show a powder coating apparatus embodying the principles of the present invention.

Referring first to FIGS. 1*a*, 1*b*, 2*a* and 2*b*, the coating apparatus of the present invention is generally indicated by the reference numeral 10 and comprises an endless foraminous conveyor belt which is generally indicated by the reference numeral 12 and a second conveyor belt which is generally indicated by the reference numeral 13. The conveyor belt 12 is made of metal which can be grounded and is supported within framework which is generally indicated by the reference numeral 17. The outer surface of the conveyor belt 13 is preferably coated with teflon and is supported within framework which is generally indicated by the reference numeral 14.

The conveyor 12 includes an upper horizontal section 15 which extends between a pair of drive rolls 16 and 18 and a return portion which extends from the drive roll 18 around a pair of rearward and forward idler rolls 21 and 22, respectively, and back to the drive roll 16. The section 15 has an upper surface 19. The rearward idler roll 21 is rotatably mounted to the end of an arm 23 which is pivotally mounted by a pivot pin 25 to the framework 17. The forward idler roll 22 is rotatably mounted to the end of an arm 24 which is pivotally mounted by a pivot pin 26 to the framework 17. Each of the rolls 21 and 22 is weighted and rests on the returning portion 20 of the conveyor 12 for maintaining tension on the conveyor 12. The drive roll 16 is mounted on a shaft 28 which is journaled between a pair of side plates 27 which forms part of the framework 17. The drive roll 18 is mounted on a shaft 30 which is journaled between the plates 27. The horizontal portion 15 of the conveyor 12 is supported on a flat horizontal support plate 34 which is fixed to the side plates 27. The horizontal portion 15 of the conveyor 12 extends through rear and forward openings 36 and 40 of a spray housing or spray booth 38. The spray housing 38 is conventional and contains spray nozzles, not shown, for directing a spray of ironized resin powder or particles toward the conveyor 12. The horizontal support plate 34 has an opening 42 at the lower end of the spray housing 38. Powder which is not deposited on the conveyor or articles carried by the conveyor pass through the foraminous conveyor 12 through the opening 42 and into a funnel 44 which leads to a duct 46. The duct 46 is connected to a source of sub-atmospheric air pressure and powder collecting means, not shown. The conveyor 13 is an endless conveyor which is trained around a rear drive roll 50 and a forward drive roll (not shown) which is driven by conventional drive means (not shown). The conveyor 13 comprises an upper ruin 48 which rides on top of a flat plate 49 which is supported by the framework 14. The conveyor 13 also comprises a lower return run 51. The roll 50 is mounted on a shaft 52 which is journaled between a pair of vertical posts 53 which form apart of the framework 14. The shaft 30 for the roll 18 is rotatably driven from the shaft 52 for the roll 50 by a chain and sprocket drive mechanism which is generally indicated by the reference numeral 54. The upper runs of the conveyors 12 and 13 are driven at the same linear velocity in the direction of arrows 55, from left to right as viewed in FIGS. 1*a*, 1*b*, 2*a*, and 2*c*. The upper run 48 of the conveyor 13 extends through a conventional curing oven 56 which comprises infrared heating lamps (not shown) for curing resin powder and cooling means, not shown, for subsequently cooling articles which have been coated.

Figure 3:
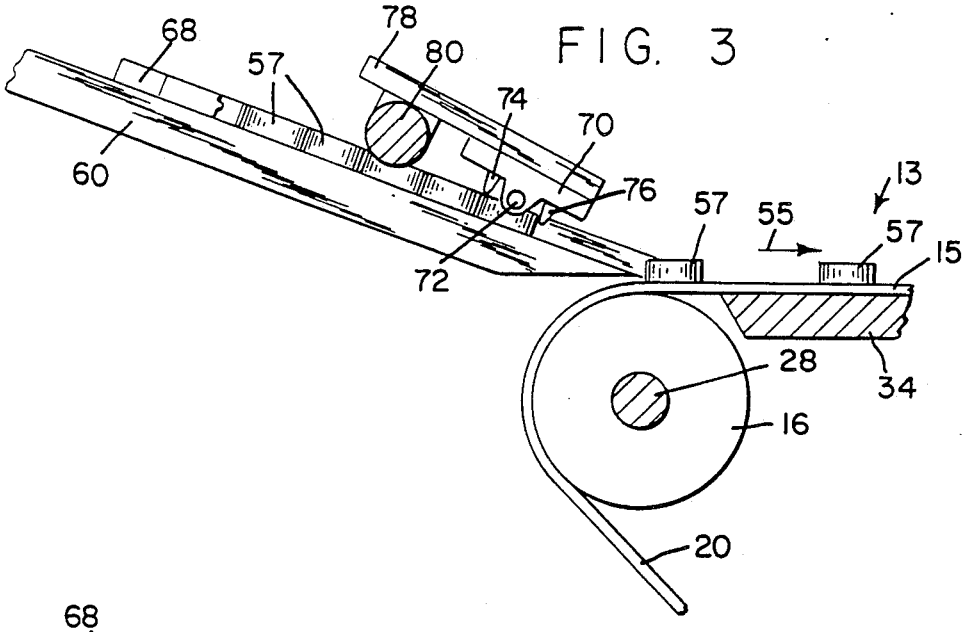
FIG. 3 is a vertical cross-sectional view on an enlarged scale taken along the line of III—III of FIG. 2*a* and looking in the direction of the arrows and showing one step of a two step sequence for transferring articles from the first conveyor to the second conveyor.
Figure 4:
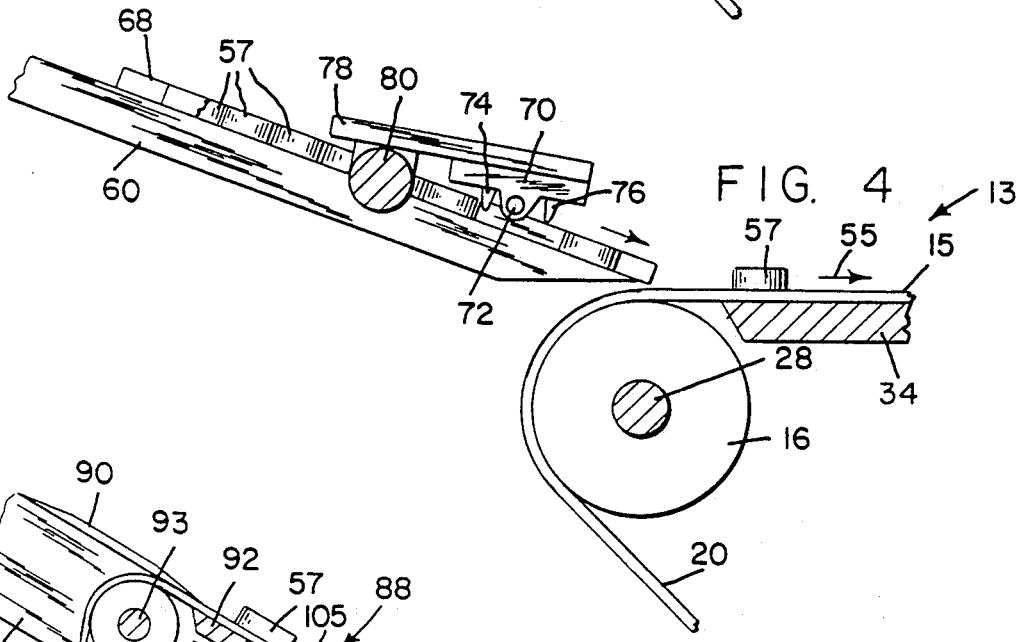
FIG. 4 is a view similar to FIG. 3 and showing the second step of the two step transfer sequence.
Figure 5:
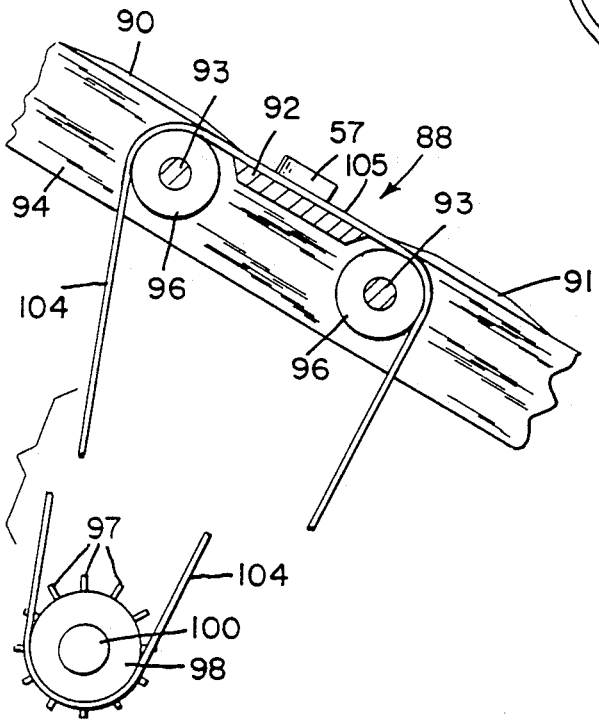
FIG. 5 is a fragmentary side elevational view on an enlarged scale of the apparatus for cleaning articles as they are transferred to a first conveyor to the second conveyor.

The articles to be coated, shown by way of example as disk 57, are deposited on the conveyor 12 by positive feed means which is generally indicated by the reference numeral 58. The positive feed means 58 comprises a slide chute 60 which is supported on framework which is generally indicated by the reference numeral 62 at the rear end of the conveyor 12. The slide chute 60 includes an upper inclined slide surface 64 which has a relatively slight incline angle and a lower slide surface 66 which has a relatively steep incline angle. A plurality of spaced elongated guide rails 68 are fixed to the lower portion of the lower slide surface 66. A metering bar 70 extends across the top of the guide rails 68. The ends of the metering bar 70 are pivotally mounted between the framework 17 by pivot pins 72 which enable the bar 70 to oscillate about a horizontal axis above the guide rails 68. The metering bar 70 includes a row of rear pins 74 and a row of forward pins 76. The pins 74 and 76 extend below the bar 70 between the guide rails 68, see also FIGS. 3 and 4. A rearwardly extending lever 78 is fixed to the top of the bar 70 and a laterally extending follower 80 is fixed to the bottom of the lever 78. The follower 80 is engaged by a cam 82 which is mounted for rotation with a shaft 84 which is journaled on a plate 81 which forms part of the framework 17. The shaft 84 is driven from the shaft 28 by means of a chain and sprocket drive mechanism which is generally indicated by the reference numeral 86. Rotation of the cam 82 causes the follower 80 to be alternately raised and lowered and causes the metering bar 70 to oscillate about the pins 72 between the position which is shown in FIG. 3 and in the position which is shown in FIG. 4.

Figure 2A:
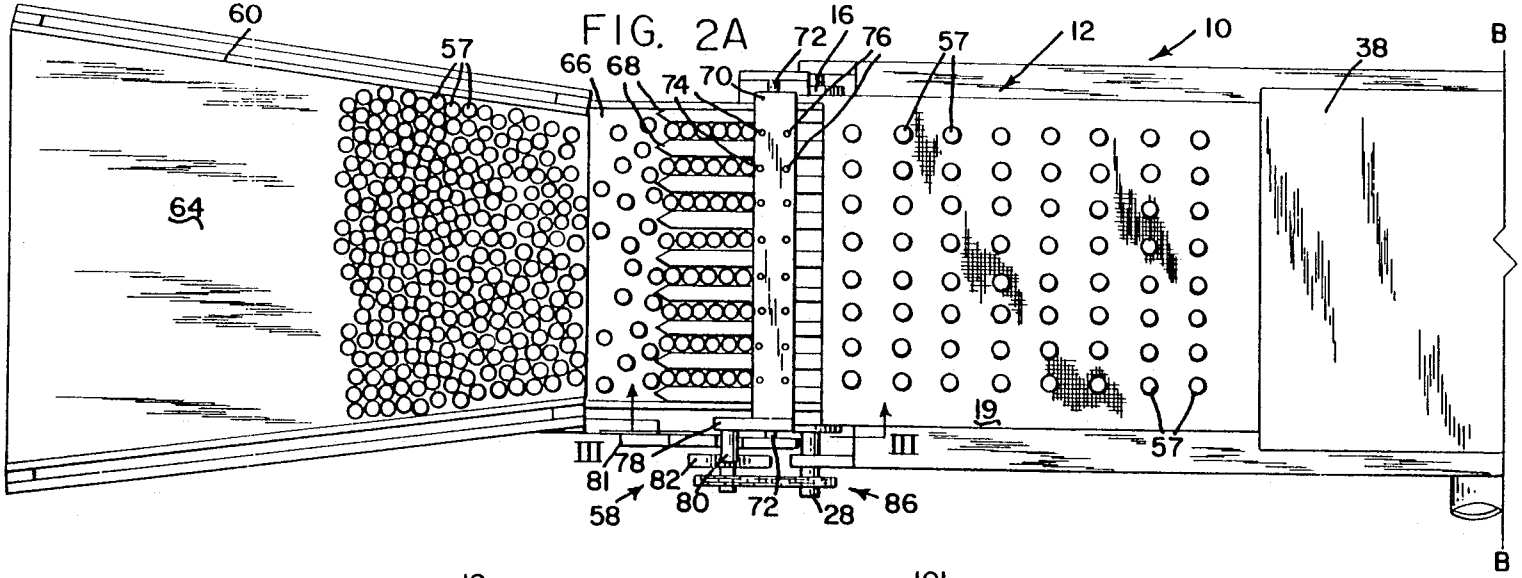
FIGS. 2*a* and 2*b* are top plan views which may be joined together along the common line B—B of the powder coating apparatus.

The articles 57 to be coated are deposited on the upper inclined slide surface 64 in a random manner. The chute 60 is vibrated by conventional vibrating means, not shown, so that the articles work their way down to the lower guard surface 66 to the guide rails 68. The upper or rearward ends of the guard rails 68 are pointed and divert the articles between the guide rails wherein the articles are aligned into a plurality of longitudinal forward to rear rows against the metering bar 70. The metering bar 70 allows one article to be released from each row of articles for each oscillation of the bar 70. Referring particularly to FIGS. 3 and 4, when the cam follower 80 is raised, the rearward pins 74 are lifted above the level of the articles. This allows the articles to pass beneath the pins 74 to the forward pins 76 which extend below the level of the articles. When the follower 80 is lowered, the rearward ends 74 are lowered to a point below the upper level of the articles to prevent the articles from passing beyond the rearward pins 74. At the same time, the forward pins 76 are raised to release the one article which was between the forward end rearward pins for each roll of articles as shown in FIG. 4. The positive feed means 58 ensure that the articles are deposited on the upper surface 19 of the horizontal section 15 of the foraminous conveyor 12 at spaced intervals in longitudinal rows as shown in FIG. 2*a*. The articles 57 are then conveyed through the spray housing 38 where they are covered with plastic resin powder. The ionized powder or resin particles cover all exposed surfaces of each article including the exposed areas of the surface of the article which rest on the surface 19 of the conveyor. Some of the particles pass through the conveyor and are then attracted upwardly to the lower surface of the article through the spaces in the conveyor. The bottom surface of the article is covered except for those areas which are in direct contact with solid elements of the conveyor.

Figure 1B:
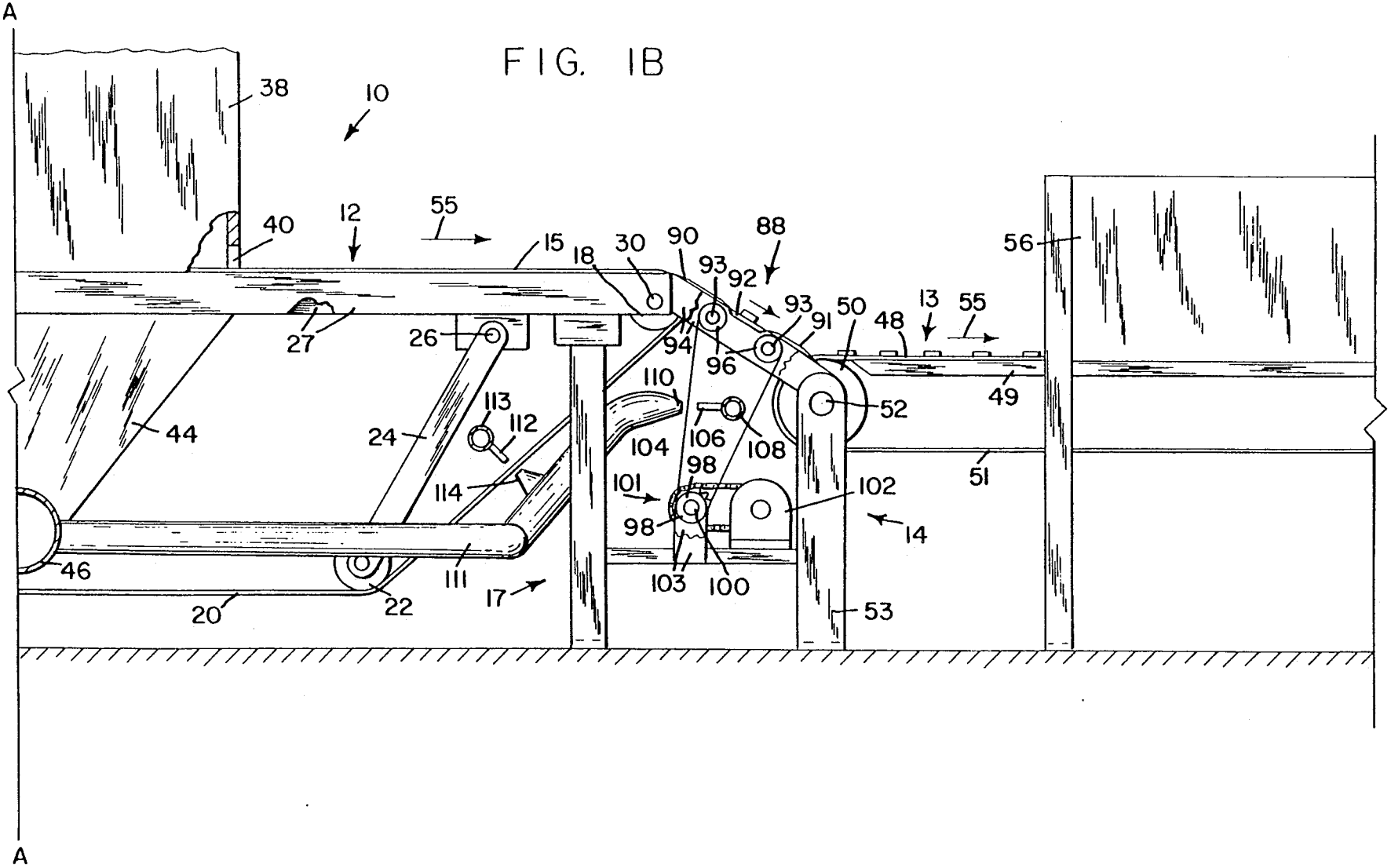
Figure 2B:
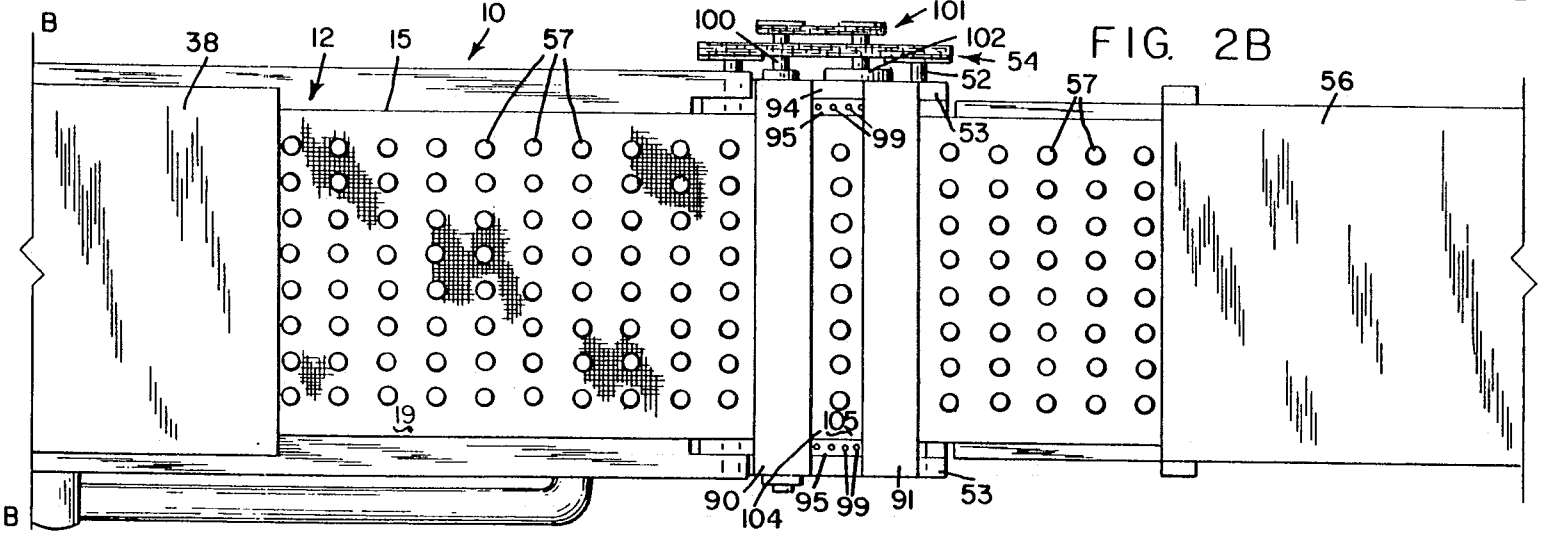

Referring particularly to FIGS. 1*b* and 2*b*, the articles 57 which pass from the spray housing 38 are coated with uncured plastic resin and are conveyed toward the conveyor 13. The articles are transferred from the conveyor 12 to the conveyor 13 by a bridging mechanism which is generally indicated by the reference numeral 88. The bridging mechanism 88 consists of a pair of spaced flat plates 90 and 91 and an intermediate plate 92 which is located between and below the plates 90 and 91. The plates 90, 91 and 92 extend transversely of the line of travel of the articles 57 and are supported at their ends by a pair of support brackets 94. The brackets 94 extend from the side plates 27 to the vertical posts 53. A pair of idler rolls 96 are rotatably mounted on a pair of parallel shafts 93 which are supported at their ends by the support brackets 94. A lower drive roll 98 is mounted for rotation with a shaft 100 which is journaled in a pair of support brackets 103. The drive roll 98 is rotated by a motor 102 through a chain and sprocket drive which is generally indicated by the reference numeral 101. An endless loop of wiping cloth 104 is trained around the drive roll 98 and the idler rolls 96 so that the cloth extends over the intermediate plate 92 and thereby presents an outer wiping surface 105 between the outer surfaces of the plates 90 and 91.

When an article reaches the end of the conveyor 12, it falls onto the plate 90 and slides across the plate 90, the wiping cloth 104 and across the plate 91 to the conveyor 13. As the article slides across the cloth surface 105, the bottom surface of the article is wiped clean of resin particles by the surface of the cloth. When the article reaches the conveyor 13, the bottom surface of the article is completely clean of resin particles. The article is thereafter further converged into the curing oven 56. Since all exposed surfaces of the article 57 are covered by uncured plastic resin, except for the bottom surface of the article, a permanent plastic coating is formed on all surfaces of the article except this bottom surface when the article emerges from the curing oven 56.

The cloth loop 104 is driven so that it travels upwardly along the plate 92 at a relatively slow speed so that the wiping surface 105 of the cloth is continuously changed. As the cloth loop 104 passes downwardly from the rearmost roller 96, resin particles or powder which have adherred to the outer surface of the cloth are removed by a flat air nozzle 106 which extends across the width of the cloth at the inner surface of the cloth. The nozzle 106 is connected to an air line 108 which is connected to a source of air at super-atmospheric pressure. A pressurized air stream is directed against the cloth 104 for dislodging resin particles from the outer surface of the cloth. These dislodged particles are then collected by a vacuum nozzle 110 at the end of a duct 111 which is operatively connected to the duct 46. The opening of the vacuum nozzle 110 is elongated and extends across the width of the cloth 104 opposite the air nozzle 106. An air nozzle 112 is located at the inner surface of the return portion 20 of the conveyor 12 and has an elongated horizontal opening which extends across the width of the conveyor. The air nozzle 112 is connected to an air line 113 which is connected to a source of air at super-atmospheric pressure. A jet of pressurized air is directed against the conveyor 20 from the air nozzle 112 to dislodge resin particles from the outer surface of the conveyor towards a vacuum nozzle 114. The vacuum nozzle 114 has an elongated horizontal opening which extends across the width of the conveyor 12 at the outer side of the conveyor and faces the air nozzle 112. The nozzle 114 is connected to the duct 111 so that particles which are collected from the conveyor 12 and the cloth 104 are drawn into the duct 46 to be joined with the particles which are collected from the conveyor at the bottom of the spray housing 38 for recycling. By cleaning the cloth 104 and advancing the cloth against the flow of articles at the bridging mechanism 88, the article passes across a clean portion of the cloth prior to reaching the forward plate 91. This insures that all remnants of resin particles are removed from the bottom surface of the article by the time the article reaches the conveyor 13. This also insures that there is no contamination of particles on the conveyor 13 as it enters the curing oven 56 so that the only resin particles which are cured in the oven 56 are those which are deposited on the articles themselves. The conveyor 12 is also maintained free of resin particles prior to its passing through the spray housing 38.

Referring particularly to FIGS. 7–11, there is shown an article which is an example of one type of article that is well suited for coating by the apparatus of the present invention. The article which is illustrated in FIGS. 7–11 is a ring which is generally indicated by the reference numeral 116 and which includes an upper surface 118 and a bottom surface 120. The ring 116 is coated by depositing the ring on the chute 60 so that the bottom surface 120 rests on the surface 64 of the chute. The ring 116 is thereafter deposited on the surface 19 of the conveyor 12 by the feed means 58 so that the bottom surface 120 rests on the upper surface 19 of the conveyor 12. The article 116 then passes through the spray housing 38 wherein all exposed surfaces of the article are coated with uncured resin powder, including areas of the bottom surface 120 which are located over openings in the conveyor. The resin particles on the lower surface 120 of the article 116 are removed by the cloth surface 105 as the article slides across the bridging mechanism 88 and is deposited on the conveyor 13. The article 116 thereafter passes through the curing oven 56 which cures the resin particles and forms a plastic coating 120 on all exposed surfaces of the article 116 except on the bottom surface 120 as shown in FIG. 10. The article 116 is then repositioned on the chute 60 so that the upper surface 118 rests on the surface 64 of the chute. When the article 116 is deposited on the conveyor 12 by the positive feed means 58, the upward surface 116 of the article rests on the upper surface 19 of the conveyor. As the article 116 passes through the spray housing 38, a complete coating of uncured resin powder is applied to the bottom surface 120 which now faces upwardly. Since the bottom coated surface 120 rests on the top surface of the conveyor 12, the article is insulated from the grounded conveyor so that it is primarily the upwardly facing bottom surface 120 which is covered with uncured resin powder. Any powder particles which happen to get on the top surface 118 of the article are removed as the article slides across the cloth surface 105 when the article transfers from the conveyor 12 to the conveyor 13. After the article 116 has made its second pass through the curing oven 56, the powder coating on the lower, now upwardly facing, surface 120 is cured and the article emerges from the curing oven 56 as a completely coated article as shown in FIG. 11.

Referring to FIG. 6, there is shown a modified metering bar which is generally indicated by the reference numeral 122. The bar 122 is similar to the metering bar 70 except that it is divided into two parts, a main part 124 and an adjustable part 126. The main part 124 is fixed to the pivot pins 72 and the lever 78 and contains the forward pins 76. The adjustable part 126 is adjustably mounted to the main part 124 for movement toward and away from the part 124 and contains the rearward pins 74. The adjustable part 126 is mounted to the main part 124 by means of a pair of adjusting screws 128 which extend freely through the adjustable part 126 and are threaded into the main part 124. Rotation of the screws 126 in one direction causes the adjustable part 126 to move toward the main part 124. Rotation of the screws 128 in the opposite direction causes the adjustable part 126 to move away from the main part 124. This enables the spacing between the pins 74 and 76 to be changed to accommodate articles of different sizes. The spacing between the rows of pins 74 and 76 is substantially equal to the diameter of the article so as to allow a single article from each row of articles to fit between the forward and rearward pins of the row. This insures that only one article is dispensed at a time for coating and the articles from each row are spaced as they enter the spray booth or housing 38.

Clearly, minor changes may be made in the form and construction of this invention and in the embodiments of the process without departing from the material spirit of either. Therefore, it is not desired to confine the invention to the exact forms shown herein and described, but it is desired to include all subject matter that properly comes within the scope claimed.

The invention having been thus described, what is claimed as new and desired to secure by Letters Patent is:

1. A method of coating an article which has at least one flat surface, said method comprising:

(a) positioning the article on a foraminous conveyor which has an upper substantially horizontal surface so that the flat surface of said article rests on said upper surface, (b) spraying the article with uncured coating particles while the article is being conveyed on said conveyor to cover exposed surfaces of said article with said particles, (c) removing all uncured coating particles from the flat surface of said article, (d) curing the coating particles on said article to form a coating on all surfaces of said article except for said flat surface, (e) positioning said article on a foraminous conveyor which has an upper substantially horizontal surface so that the article rests on the upper surface of said conveyor with the flat surface of said article out of contact with said upper surface, (f) spraying the article with said uncured coating particles so that said flat surface is completely covered with said particles, and (g) curing the uncured coating particles on said flat surface so that said article is coated completely.

2. A method of coating an article as recited in claim 1, wherein said coating particles on the article are cured by transferring the coated article from said foraminous conveyor to a second conveyor and passing said second conveyor and article through a curing oven.

3. A method of coating an article as recited in claim 2, wherein said foraminous conveyor is cleaned of uncured coating particles after the article has been transferred to said second conveyor.

4. A method of coating an article as recited in claim 2, wherein the uncured coating particles are removed from the flat surface of said article by wiping said flat surface with a cloth surface during the transfer of said article from said foraminous conveyor to said second conveyor.

5. A method of coating an article as recited in claim 1, wherein said article and said foraminous conveyor are metallic and said coating particles are plastic.

6. A method of coating an article as recited in claim 1, wherein said coating particles on the article are cured by transferring the coated articles from said foraminous conveyor to a second conveyor and passing said second conveyor and article through a curing oven.

7. A method of coating an article as recited in claim 6, wherein said foraminous conveyor is cleaned of uncured coating particles after each transfer of said article to said second conveyor.

8. A method of coating an article as recited in claim 6, wherein the uncured coating particles are removed from the flat surface of said article by wiping said lower flat surface with a cloth surface during the first transfer of said article from said foraminous conveyor to said second conveyor.

9. A method of coating an article which has an upper flat surface and an opposite lower flat surface, said method comprising:

(a) positioning the article on a foraminous conveyor which has an upper substantially horizontal surface so that the lower flat surface of said article rests on said upper surface, (b) spraying the article with uncured coating particles while the article is being conveyed on said conveyor to cover exposed surfaces of said article with said particles, (c) removing all uncured coating particles from the bottom flat surface of said article, (d) curing the coating particles on said article to form a coating on all surfaces of said article except for said lower flat surface, (e) positioning said article on a foraminous conveyor which has an upper substantially horizontal surface so that the upper flat surface of the article rests on the upper surface of said conveyor, (f) spraying the article with said uncured coating particles so that said lower flat surface is completely covered with said particles, and (g) curing the uncured coating particles on said lower flat surface so that said article is coated completely.

10. A method of coating an article as recited in claim 9, wherein said article and said foraminous conveyor are metallic and said coating particles are plastic.

* * * * *